United States Patent [19]

Kirkis

[11] Patent Number: 4,457,447

[45] Date of Patent: Jul. 3, 1984

[54] PLASTIC PAIL AND LID

[75] Inventor: Peter G. Kirkis, Toronto, Canada

[73] Assignee: Vulcan Industrial Packaging Limited, Toronto, Canada

[21] Appl. No.: 482,500

[22] Filed: Apr. 6, 1983

[51] Int. Cl.[3] ..... B65D 41/16; B65D 41/18

[52] U.S. Cl. ..... 220/306; 220/308

[58] Field of Search ..... 220/306, 307, 308; 150/0.5

[56] References Cited

U.S. PATENT DOCUMENTS

| | | | |
|---|---|---|---|
| 3,061,139 | 10/1962 | Edwards | 220/44 |
| 3,381,872 | 5/1968 | Holder et al. | 220/44 |
| 3,516,571 | 6/1970 | Roper et al. | 220/60 |
| 3,567,016 | 3/1971 | Bardell | 220/306 |
| 3,651,981 | 3/1972 | Kinney | 220/306 |
| 3,696,962 | 10/1972 | Fehres et al. | 220/306 |
| 3,759,415 | 9/1973 | Cloyd | 220/306 |
| 3,848,767 | 11/1974 | Naf | 220/308 |
| 3,963,120 | 6/1976 | Perfect | 206/219 |
| 3,999,677 | 12/1976 | Oberkircher | 220/266 |
| 4,166,549 | 9/1979 | Schutz et al. | 220/319 |
| 4,177,930 | 12/1979 | Crisci | 220/306 |
| 4,228,916 | 10/1980 | Weingardt | 220/354 |
| 4,234,100 | 11/1980 | Chabot | 220/306 |
| 4,257,527 | 3/1981 | Snyder et al. | 220/72 |
| 4,296,871 | 10/1981 | Andersson | 220/306 |

*Primary Examiner*—George T. Hall

*Attorney, Agent, or Firm*—Ridout & Maybee

[57] ABSTRACT

A molded plastic pail has a pair of continuous annular flanges molded integrally on its outer wall extending radially outwardly and defining between them a free, continuous channel of constant cross-section extending around the entire circumference of the pail. The flanges facilitate the handling of the filled pails on automatic handling apparatus having grab fingers which can engage in the channel between the flanges without disturbing the lid of the pail. The inner surface of the downwardly-depending rim of the lid is formed with a series of axially-extending grooves which, when the lid is applied over the container, define venting spaces between the lid and the outer side of an outwardly-turned bead on the upper edge of the container, thus relieving the pressure of air trapped under the lid as it is applied over the mouth of the container. The underside of the lid has a downwardly-depending annular flange defining with the rim of the lid a downwardly-opening channel for receiving a sealing gasket or the like. The lid has a downwardly-depressed central portion for receiving the base of a container when a number of containers are stacked one on another. Reinforcing ribs extend radially between the downwardly-depending flange and the downwardly-depressed portion and have their lower edges inclining upwardly and inwardly to provide a greater reinforcement of the lid against deflection under axial load with savings in the quantity of molding plastic consumed.

15 Claims, 5 Drawing Figures

PLASTIC PAIL AND LID

The present invention relates to a molded plastic pail and lid therefor especially, although not exclusively, suitable for the packaging of lubricating oils.

A previously-proposed pail as shown in U.S. Pat. No. 3,696,962 Fehres et al, dated Oct. 10, 1972 has a lid which is retained on the pail by a metal locking ring which extends around the periphery of the lid and which has to be broken off before the pail can be opened. The Fehres et al has a side wall with an outwardly-projecting circumferential rib disposed below the rim of the lid. The locking ring or band engages this rib to retain the lid in sealed engagement with the pail.

Other kinds of pail employ lids having an inwardly-directed shoulder engaging an outwardly-turned bead on the upper edge of the side wall of the pail and the rim of the lid extends downwardly at a spacing with respect to the outer surface of the side wall of the pail and forms a downwardly-depending stiffening skirt extending continuously around the side of the pail. It is with pails of the latter kind that the present invention is concerned. In some cases, the above-mentioned stiffening skirt on the lid extends axially a sufficient distance that the skirt constitutes a stiffening member of rich rigidity that it prevents the shoulder on the lid from being disengaged from the bead by levering the skirt upwardly and outwardly at a point on its circumference without destroying the integrity of the structure. In such case, the lid is usually removed by cutting vertically through the stiffening skirt at one or more points, to enable the skirt to be flexed outwardly sufficiently to permit the shoulder to be disengaged from the bead.

Particularly with pails of larger sizes, it is desirable that the filled pail, containing a desired product and having its lid applied, should be capable of being handled by automatic handling apparatus, so that the handling of the filled pails can be made more efficient. Known designs of pails, have, however, not been well adapted to be handled by automatic handling apparatus such as automatic palletizing apparatus.

In one form, the present invention provides a pail having first and second continuous annular flanges molded integrally on its outer side, the upper of these flanges extending outwardly below and adjacent the lower edge of the rim of the lid for a distance at least equal to the radial extent of the outer side of the rim of the lid. These flanges define between them a free, continuous annular channel desirably of constant cross-section extending around the entire circumference of the pail. Below the second flange, and generally parallel to and spaced downwardly therefrom is a thrid flange also molded integrally with the side wall of the pail. The side wall of the pail tapers inwardly downwardly from the third flange and presents a smoothly continuous frusto-conical surface permitting empty pails to be stacked one inside the other with the lower surface of the third flange of each pail resting on the upper surface of the bead of the pail immediately beneath. In the stacked configuration, the channel between the first and second flanges is exposed and thus the pail, whether empty or filled and having its lid applied, is very well adapted to be handled by automatic palletizing apparatus of known form having grab fingers which are adapted to grip the outer side of generally cylindrical objects which are desired to be palletized. In the present case, the apparatus can be employed to engage within the above-mentioned annular channel defined between the first and second flanges. The arrangement of the first and second flanges also prevents or reduces risk of the automatic handling apparatus dislodging the lid filled pail. In the case in which the pail is filled with a lubricating oil, the lid may be particularly prone to being dislodged, as a result of a film of lubricating oil which may become spread around the mouth of the pail and the inner side of the lid.

In a further aspect, the inner side of the rim of the lid, at least over a major portion of a region where the inner side of the rim flares outwardly away from the side wall of the pail at an inner diameter at least equal to the outer diameter of the bead, is formed with an array of axially extending grooves recessed into the inner side of the rim. This arrangement avoids or reduces a problem arising in the packaging of lubricating oils and like liquid products which may tend to become spread over the co-operating surfaces of the pail and lid, and which may tend to form a gas-tight seal on the application of the lid to the pail, thus trapping a volume of air above the liquid product within the pail and preventing the lid from being pressed completely down into full engagement with the upper edge of the pail. With the above arrangement, the grooves on the inner side of the rim form with the bead venting spaces for venting trapped air from the interior of the pail as the lid is compressed downwardly over the bead.

In a further aspect, the wall of the pail tapers in diameter toward the bottom, and the lid is formed with a downwardly-recessed central portion which is adapted to snugly receive the bottom edge of a similar pail when stacked thereon. Outwardly from the central portion, the lid is formed integrally on its underside with a downwardly-extending annular flange which has a lower edge disposed inwardly of the side wall of the pail when the lid is fitted to the pail. This annular flange strengthens and reinforces the structure, and also defines with the outer rim portion of the lid an annular downwardly-opening channel which can be used to locate a sealing gasket in the event that a liquid or gas-tight seal is desired when the lid is fully pressed home so that the upper edge of the pail is received within the downwardly-opening channel. A plurality of radially-extending ribs bridge between the inner side of the flange and the underside of the portion of the lid bordering the central portion, each of these ribs having a lower edge which inclines upwardly and inwardly toward the central portion of the lid. The provision of these radially-extending ribs reinforces the lid structure against deflection under the weight of similar containers stacked thereon, which deflection could impair the closure effected between the lid and the pail. It has been found that with the above-described arrangement in which the lower edges of these ribs incline upwardly and inwardly, these ribs provide an improved reinforcement of the lid against such deflection, while using less plastic as compared with similar lids in which the lower sides of the radial ribs extend parallel to the general plane of the lid.

A preferred embodiment of the pail in accordance with the invention is illustrated in the accompanying drawings in which.

Figure 1:
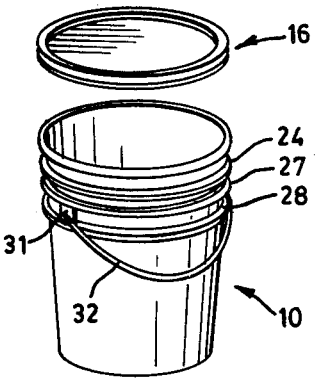
FIG. 1 shows a perspective view of a pail and its lid in accordance with the invention.

Referring to the drawings, a one-piece molded plastic pail 10 has a side wall 11 tapering downwardly from an outwardly turned bead 12 at the upper edge to a foot portion 13. The pail includes an integrally-molded circular bottom wall 14.

Figure 4:
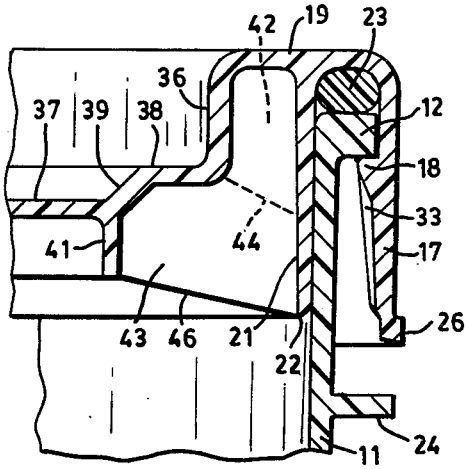

An integrally-molded lid 16 has a downwardly-depending rim portion 17 which on its inner side is formed with a shoulder 18 which, when the lid is pressed downwardly into engagement with the pail 10, engages beneath the bead 12, as shown in FIG. 4. Desirably, the inter-engaging surfaces of the bead 12 and shoulder 18 extend in profile linearly outwardly, in a horizontal plane or at a downward inclination, i.e. with a downward and outward rake angle at least equal to zero, so that the shoulder snap-fits positively over the bead.

In the preferred form, as shown, the lid includes an upper annular portion 19 from which extends an integrally-molded downwardly-extending continuous annular flange 21. The lid may be applied on the pail with downward pressure applied uniformly around the upper portion 19, to uniformly flex the rim portion 17 outward until the shoulder 18 snaps over the bead 12. When the lid is applied, as shown in FIG. 4, this flange 21 abuts the side wall 11 but has its lower edge 22 disposed inwardly of the side wall 11. The flange 21 may tend to bias the wall 11 outwardly thus tending to form a secure interlock between the bead 12 and the shoulder 18.

The flange 21 defines with the upper portion of the rim 17 a continuous annular channel which, in the preferred form, as shown, locates an annular O-ring type elastomeric or rubber gasket 23. The gasket 23 is resiliently deformed by the bead 12 and exerts a resilient bias between the lid and the pail 12, urging the lower face of the bead 12 and the upper side of the shoulder 18 into firm engagement.

Figure 2:
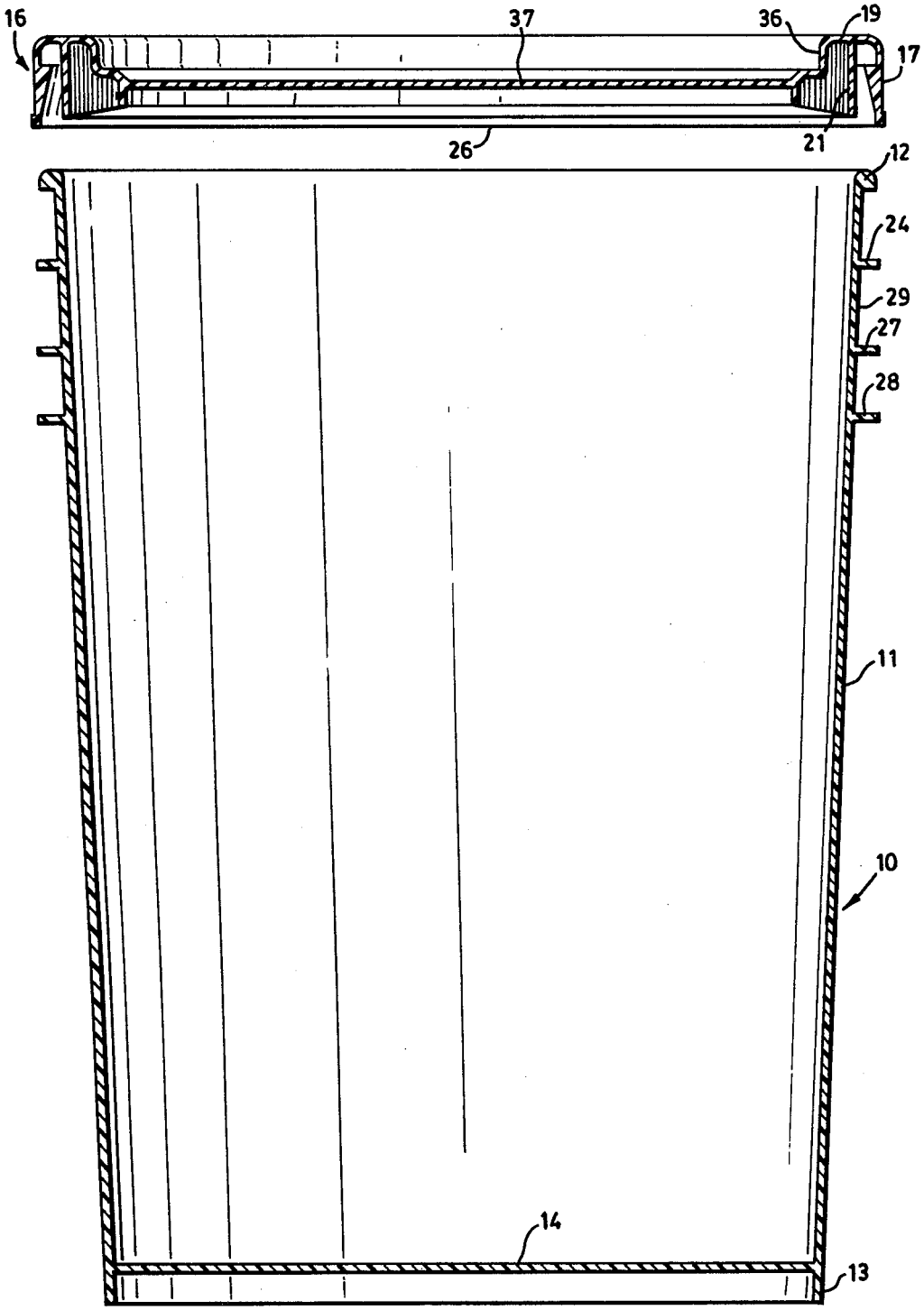
FIG. 2 shows a section through the pail and lid on an enlarged scale.

The outer side of the wall 11 of the pail is formed integrally with at least two continuous annular flanges. The uppermost flange 24, which extends in a plane perpendicular to the axis of the pail 11, and parallel to the bottom wall 14 is disposed at a point closely adjacent to the lower edge 26 of the rim 17 in the as-applied position of the lid defined by the engagement of the bead 12 and shoulder 18. The radial extent of the flange 24 is at least equal to the radial extent of the widest portion of the lid 16, in this case the lower edge 26 of the rim 17. Below the flange 24 are two similar and parallel flanges 27 and 28. It will be noted that the outer surface of the wall 11 between the flanges 24 and 27 is a simple frustro-conical surface conforming to the general frustro-conical surface of the entire wall 11 around the entire circumference of the wall 11, and there is no projection into the annular channel defined between the surface 29 and the adjacent sides of the flanges 24 and 27 which thus together define a free-continuous annular channel of constant section extending around the entire circumference of the pail 11. Between the flanges 27 and 28, however, a pair of lugs are molded integrally with the side wall 11, one on each side of the pail, one of these lugs 31 being visible in FIG. 1. These lugs 31 serve as attachment points for connection of a conventional form of handle 32. Further, as will be noted from FIGS. 1 and 2, the side wall 11 of the pail tapers inwardly downwardly from below the lowermost flange 28 and presents a smoothly continuous frusto-conical outer surface. As will be apparent from consideration of FIG. 2, this permits empty pails to be stacked one inside the other with the lower surface of the lowermost flange 28 of each pail resting on the upper surface of the bead 12 of the pail immediately beneath.

In the preferred embodiment as shown, the axial extent of the downwardly-depending rim portion 17 is such that it constitutes a stiffening skirt of such rigidity that, once applied, the lid 16 can not be disengaged from the pail 10 by levering it upwardly at a single point on its circumference, without destroying the integrity of the structure. Thus, in order to remove the lid from the pail, the user will normally cut through the material of the rim portion 17 along a vertical line extending from the upper portion 19 to the lower edge 26 at one or more places around the periphery of the lid, in order to permit the cut rim portion 17 to be flexed outwardly and allow the lid 16 to be disengaged from the pail 10. For this purpose, the outer side of the rim portion 17 may be molded with one or more vertically-extending grooves or lines of weakness on its outer side to facilitate the cutting of the plastic material.

With the above arrangement, the flanges 24 and 27 define a circumferentially-extending endless channel for receiving and locating curved grab fingers such as may be used for the lifting of the filled pails on automatic handling apparatus. Even though the attachment of the lid 16 to the pail body 10 is relatively secure, it has been found that the pressure exerted by such grab fingers in lifting a filled pail may be distributed around the circumference of the pail in such manner that it would, if exerted direct on the lower edge 26 of the rim 17, tend to dislodge the lid 16 from the pail 10. This risk may be particularly acute in the case where the pail is filled with a product having lubricating properties. With the above arrangement, however, owing to the radial extent of the flange 24 and its position adjacent the lower edge 26, there is little risk of the grab members coming into contact with the edge 26 of the rim portion 17, and thus risk of dislodging of the lid 16 is greatly reduced.

Figure 3:
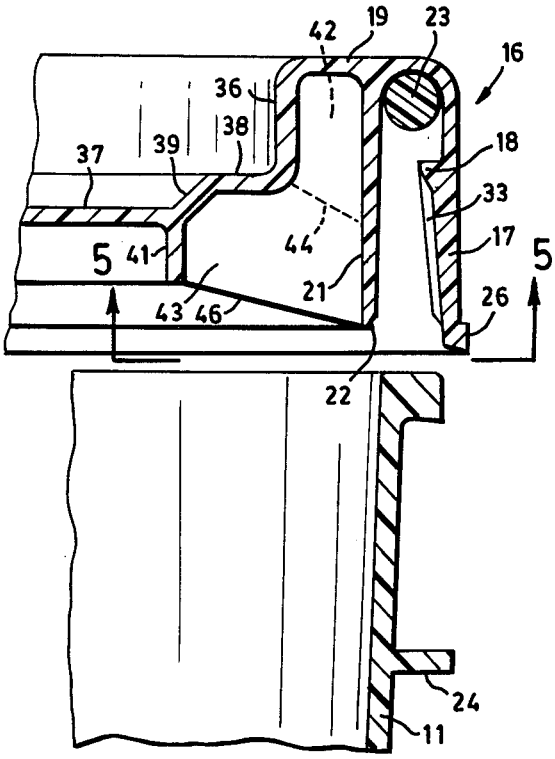
FIGS. 3 and 4 show sections through the periphery of the lid and upper edge of the pail with the lid prior to engagement and in engagement, respectively.

The inner side of the rim portion 17 flares downwardly and outwardly from the shoulder 18, which defines an annulus with a diameter smaller than that of the bead 12, to the lower edge 26, adjacent which the inner side of the rim portion 17 has a diameter greater than that of the bead 12. Downward from the shoulder 18 and over the major portion of the inner side of the rim 17, the rim is molded integrally with an array of castellations 33, which taper in thickness from immediately below the shoulder 18, which forms a continuous annular inner surface of narrow axial extent, toward the lower edge 26, and define between them a series of axially-extending grooves 34, of uniform width and spacing. As will be appreciated from FIG. 3, when the lid 16 is compressed downwardly over the bead 12, the grooves 34 define with the outer side of the bead 12 a series of venting spaces for venting air trapped under the lid 16 from the upper part of the pail 11 and from above the product that is filled into the pail. Where the pail holds a lubricating oil, the oil may tend to spread over the outer surface of the bead 12. The venting grooves 34 can thus reduce problems of a film of oil or like liquid on the outer side of the bead 12 tending to form a seal with the inner side of the rim 17 as the lid is compressed downwardly over the bead 12, which would tend to result in a pocket of compressed gas being trapped within the upper part of the pail. This would exert an upward pressure tending to resist the application of the lid, and could prevent the lid from being applied securely.

Figure 5:
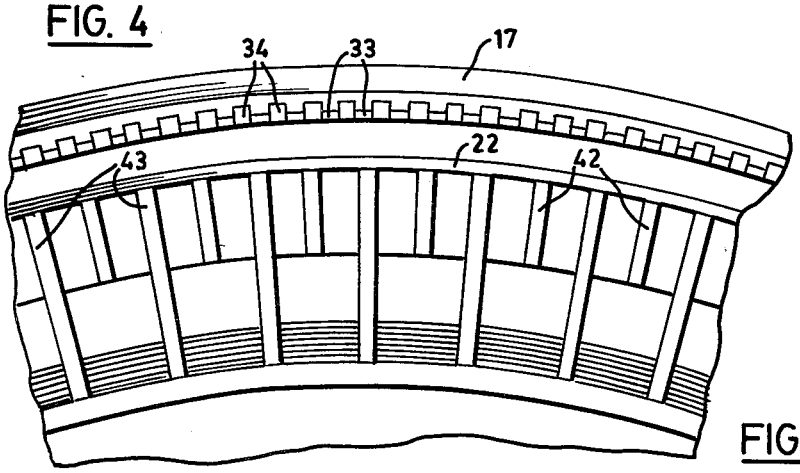
FIG. 5 shows a partial view of the underside of the lid taken along the line 5—5 in FIG. 3.

The lid 16 has a downwardly-recessed central portion defined by a downwardly-turned annular inner wall 36 which is of a diameter to snugly receive the foot portion 13 of a similar pail when a number of the filled pails 10, fitted with lids 16, are stacked one on another. To provide increased rigidity and strength to the lid 16 to permit this to support the weight of a number of filled pails when stacked thereon, the lid 16 is provided with a downwardly-dished central portion 37 which connects with the wall 36 through a horizontal annular wall portion 38 and an inwardly downwardly inclined annular wall portion 39. On the underside of the lid at the junction between the walls 37 and 39, the lid is provided with an integrally-molded downwardly-extending annular stiffening flange 41. The weight of one or more filled pails when pressing downwardly on the lid 16 through an annular foot portion 13 resting on the lid 16 adjacent the junction between the walls 36 and 38, exerts a tensile stress on the lid 16 tending to warp or deflect the lid and flex the wall portions 19, 36, 38, and 39 downwardly and outwardly toward the rim portion 17. This warping of the lid 16 may lead to a stack of the filled pails tilting, possibly leading to toppling of the stack, and to disengagement of the lid 16 from the pail. In order to reinforce the lid structure against warping, radially-directed reinforcing ribs are provided. As seen from beneath in FIG. 5, a first series of ribs 42 extend between and are molded integrally with the inner face of the annular flange 21 and the outer face of the annular wall 36. A further series of ribs 43, of greater axial extent, extend between and are molded integrally with the inner side of the flange 21 and the downwardly-depending reinforcing flange 41. It will be noted that the ribs 42 and 43 are spaced apart regularly around the circumference of the lid, with a shorter rib 42 being interposed between pairs of adjacent ribs 43. It has been found that the reinforcing effect of these ribs 42 and 43, in tending to resist the above-described warping of the lid 16 is enhanced, as compared with comparably-formed ribs of similar dimensions, when the ribs 42 and 43 are formed with their lower edges inclining upwardly and inwardly away from the annular flange 21. By providing these ribs 42 and 43 with upwardly and inwardly-inclining lower edges 44 and 46, a greater degree of reinforcement against warping deflection of the lid is achieved with lesser consumption of the plastic material employed for the molding of the lid structure 16.

In the preferred form, the pail 10 and lid 16 will be molded of a relatively stiff plastic material, employing injection-molding techniques which are in themselves conventional. Examples of suitable plastic materials include high-density polyethylene, polypropylene, and copolymers thereof.

I claim:

1. A molded plastic pail having a bottom wall, an annular side wall formed with an outwardly-turned bead adjacent its upper edge, a generally circular lid having a continuous annular downwardly-turned peripheral rim fitting over the upper edge of the side wall and having on its inner side an annular shoulder engaging under said bead, said rim extending downwardly at a spacing with respect to the outer surface of the container side wall below said bead from said shoulder to a lower annular edge of said rim, thereby forming a downwardly-depending stiffening skirt extending continuously around the side wall and defining an upwardly extending annular cavity therewith, a first continuous annular flange molded integrally with the pail side wall and extending outwardly therefrom below and adjacent the lower edge of the lid rim a distance at least equal to the radial extent of the outer side of said rim, the flange being generally parallel to the pail bottom wall, a second continuous annular flange generally parallel to and spaced downwardly below the first flange and molded integrally with the pail side wall, the outer surface of the pail side wall and the adjacent sides of said flanges defining between them a free, continuous channel of constant section extending around the entire circumference of the pail and a third continuous annular flange generally parallel to and spaced downwardly below the second flange and molded integrally with the pail side wall, the side wall of the pail tapering inwardly downwardly from the third flange and presenting a smoothly continuous frusto-conical outer surface permitting empty pails to be stacked one inside the other with the lower surface of the third flange of each pail resting on the upper surface of the bead of the pail immediately beneath.

2. A pail as claimed in claim 1 wherein said lid is molded from stiff plastic and said skirt extends axially a sufficient distance that the skirt constitutes a stiffening member preventing the shoulder on the lid from being disengaged from the bead by levering the skirt upwardly and outwardly at a point of its circumference without destroying the integrity of the structure.

3. A pail as claimed in claim 1 wherein the spacing between the lower edge of the rim of the lid applied on the pail and the upper side of the first flange is relatively small compared with the width of the channel between the first and second flanges.

4. A pail as claimed in claim 3 wherein said spacing is less than about half said width.

5. A pail as claimed in claim 1 wherein the upper side of said shoulder and the lower side of said bead each present a substantially linear profile.

6. A pail as claimed in claim 1 wherein the upper side of said shoulder and the lower side of said bead are each substantially planar.

7. A molded plastic pail having a bottom wall, an annular side wall formed with an outwardly turned bead adjacent its upper edge, a generally circular lid having a continuous annular downwardly turned peripheral rim fitting over the upper edge of the side wall and having on its inner side an annular shoulder engaging under said shoulder, the inner side of the rim extending downwardly and flaring outwardly below the shoulder to a zone defining an inner circumference at least equal to the outer circumference of the bead, and wherein over at least a major portion of the inner side of the rim between said zone and said shoulder, the inner side of the rim is formed with an array of axially extending grooves recessed into said inner side, whereby when the lid is compressed downwardly over the bead, the grooves form with the bead venting spaces for venting pressure from the interior of the pail.

8. A pail as claimed in claim 7 wherein the grooves extend from said zone to a continuous annular surface of the inner side of the rim adjacent the shoulder, the surface having an axial extent which is small compared to that of the grooves.

9. A pail as claimed in claim 7 in which the grooves are of rectangular section.

10. A pail as claimed in claim 7 in which the grooves define between them an array of regular rectangular castellations disposed around the inner side of the rim.

11. A molded plastic pail having an annular side wall tapering downwardly from its upper edge to a circular bottom edge of reduced diameter, a generally circular lid having a continuous annular downwardly-turned peripheral rim engaging the outer side of the upper edge of the side wall, an upper annular lid portion extending over the upper edge of the side wall to a downwardly turned annular inner wall of a diameter to snugly receive the bottom edge of a similar pail when stacked thereon and connecting with a central portion of the lid recessed downwardly with respect to said upper annular lid portion, the latter being formed integrally on its underside with a downwardly extending annular flange having a lower edge disposed inwardly of the pail side wall, and a plurality of radially extending ribs bridging between the inner side of the downwardly extending flange and the underside of a portion of the lid disposed radially inwardly therefrom, each of said ribs having a lower edge which inclines upwardly and inwardly toward said portion of the lid.

12. A pail as claimed in claim 11 wherein said ribs extend from the lower edge of said flange to the lower edge of a second annular flange extending downwardly from said lid central portion.

13. A pail as claimed in claim 11 wherein said ribs extend between an intermediate part of the downwardly extending flange and said downwardly turned annular inner wall.

14. A pail as claimed in claim 1 having integrally molded on the outside of its side wall between the second and third flanges a pair of lugs providing attachment points for connection to a pail handle.

15. A pail as claimed in claim 1 in which the lid is formed integrally on its underside with a downwardly extending annular flange having a lower portion disposed inwardly of the pail side wall and an upper portion on the outer side of which is located an annular gasket resiliently deformed between the underside of the lid and the upper surface of the bead on the upper edge of the side wall of the pail.

* * * * *